US006851208B2

(12) United States Patent
Carter

(10) Patent No.: US 6,851,208 B2
(45) Date of Patent: Feb. 8, 2005

(54) SIMULATED FIREFLY

(76) Inventor: Timothy L. Carter, 18400 Prairie St., #227, Northridge, CA (US) 91325

( * ) Notice: Subject to any disclaimer, the term of this patent is extended or adjusted under 35 U.S.C. 154(b) by 0 days.

(21) Appl. No.: 10/724,525

(22) Filed: Nov. 26, 2003

(65) Prior Publication Data

US 2004/0177536 A1 Sep. 16, 2004

Related U.S. Application Data

(60) Provisional application No. 60/454,738, filed on Mar. 14, 2003.

(51) Int. Cl.[7] ..... G09F 19/00

(52) U.S. Cl. ..... 40/429; 416/244 R; 40/442; 362/96; 362/286

(58) Field of Search ..... 40/442, 427, 429, 40/430, 431, 439, 470; 362/96, 407, 286; 416/5, 244 R

(56) References Cited

U.S. PATENT DOCUMENTS 6,196,803 B1 * 3/2001 Hill et al. ..... 416/244 R
6,676,375 B2 * 1/2004 Steeves LeBlanc et al. .... 416/5

* cited by examiner

*Primary Examiner*—Cassandra Davis
(74) *Attorney, Agent, or Firm*—Fulbright & Jaworski L.L.P.

(57) ABSTRACT

A firefly simulation device which has a first depending flexible line segment, a motor driven fan at the distal end of the first depending flexible line segment, a second depending flexible line segment and an LED at the distal end of the second depending flexible line segment. The fan provides thrust in a plane normal to the first depending flexible line segment. The LED has a small light-transmitting opening able to be eclipsed by the LED body. In a darkened environment, the device provides apparent random motion and blinking of a light simulating a firefly.

8 Claims, 1 Drawing Sheet

SIMULATED FIREFLY

This application claims priority to U.S. Provisional Patent Application Ser. No. 60/454,738, filed Mar. 14, 2003.

BACKGROUND OF THE INVENTION

The field of the present invention is special effects devices.

Fireflies exhibit apparent random motion and produce a yellow/green light which appears to go on and off randomly. Of course fireflies are not available at all times of the year, have geographic limitations, cannot be retained without restraint such as by screens and do not last very long. Consequently, a firefly simulation has great advantage for more permanent and controllable displays and visual effects.

SUMMARY OF THE INVENTION

It is an object of the invention to provide an approximation of the visual effect generated by fireflies or other random motion generators of light.

DETAILED DESCRIPTION OF THE PREFERRED EMBODIMENT

Figure 1:
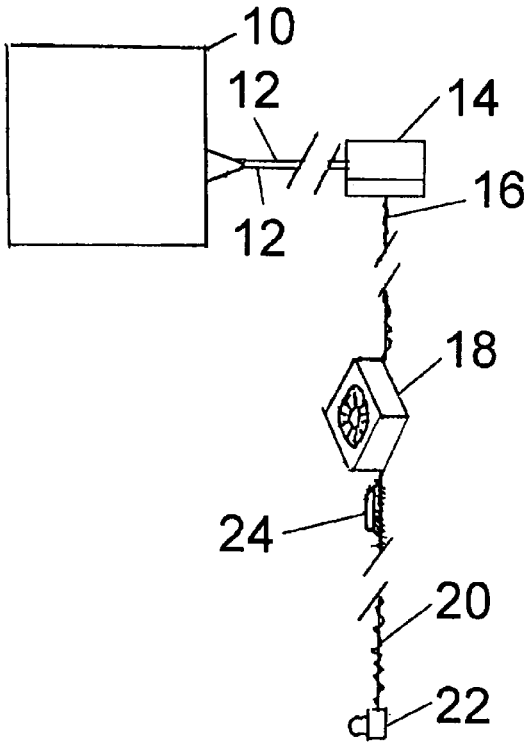
FIG. 1 is a side view of a firefly simulation.

FIG. 1 illustrates a firefly simulation device which is shown to include a transformer 10 for transforming line voltage to the transformer into 4.5 volt DC. Leads 12 extend from the transformer 10 to a quick connect coupling 14 and may extend to additional such couplings 14 (not shown) where multiple such devices are used in a display. The quick connect coupling 14 is at the proximal end of a twisted pair of wires 16 depending therefrom with a motor driven fan 18 at the distal end of the wires 16. The wires 16 are electrically coupled with the fan 18. A twisted pair of wires 20 depend at their proximal end from the fan 18 and extend to an LED light source 22 at their distal end. The wires 20 electrically couple the first wires 16 to the LED 22. In operation, the LED appears to an observer, where there is low ambient light around the device, as a small source of light that moves very randomly and periodically flashes on and off. The components of this device are configured to achieve this result.

The wires 16 are intended to provide little resistance to bending and twisting in order that the fan 18 is free to move responsive to the thrust of the propeller and in turn move the depending LED 22. Further action is achieved by the wires 20, also allowing bending and twisting. The wires 16, 20 which have been found advantageous for this device are 30 gauge solid core insulated wires. The wires 16, 20 are preferably black to disappear in a dark environment. Further, they are tightly twisted to form two depending flexible line segments. The twisting reduces handling issues. A regular power drill has been used to create a permanent twist in the wires. In this embodiment and with this fan 18 and the wires as described, the length of the wires 16 is preferably 38 inches or longer while the length of the wires 20 is 12 inches or longer.

The fan 18 is a small, lightweight propeller fan. The capacity of the fan 18 is 140 milliamps. The fan 18 is oriented such that the axis of the propeller is substantially perpendicular to the elongate direction of the wires 16, 20. As such, the thrust generated by the fan 18 is substantially in a plane normal to the depending line segment defined by the wires 16. As the fan 18 is also mounted on the wires and the wires twisted, the fan moves very randomly. The size of the propeller fan 18 that is provided in the preferred embodiment is 1½ inches square with a depth of ½ inch.

Depending on the demand of the LED, a resistor 24 drops the voltage in one of the wires 20. In one embodiment, the drop is to approximately 1.2 volts. The 1.2 volt supply is directed to the LED 22 depending from the end of the wires 20. Another LED which provides a yellow-green light much as a firefly is a green LED rated at 2.2 volts but run at 3 volts.

The LED 22 has a body and a lens. The lens and, if necessary, the body, are coated with black paint or other substance to prevent passage of the light from the LED. A small hole of approximately 1/32" to 1/16" is made through the coating to form a light transmitting opening and expose the light. This hole is placed so that it is on the side of the LED 22 in the orientation of the LED 22 as shown in FIG. 1 depending from the wires 20. As such, the rotation of the LED will cause the light to appear to flash on and off as the LED body eclipses the light transmitting opening. LED's typically provide a clearer light directly in front of the emitter. Consequently, the LED is best oriented with the emitter directed horizontally with the hole directly in front of the emitter.

Figure 2:
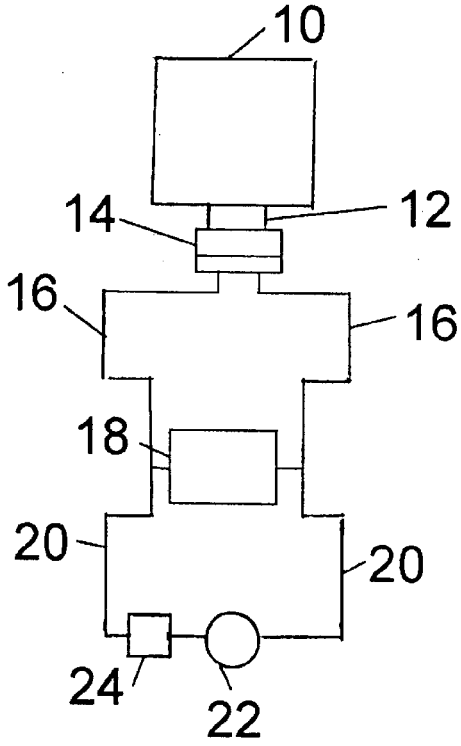
FIG. 2 is a circuit diagram of the device of FIG. 1.

FIG. 2 illustrates a simplified circuit with the transformer 10 and the two wires 12 leading therefrom to the quick connect coupling 14 and the two wires 16 leading therefrom to the contacts of the fan 18. The two wires 16 again are tightly twisted. The wires 20 depending from the leads of the fan 18 are also tightly twisted with one of the wires including a resistor 24 to drop the voltage to 1.2 volts to be applied to the LED 22.

With the foregoing mechanism, the appropriate effect is achieved through powering the fan 18 and the LED 22 in a darkened environment. The fan blows about randomly due to the thrust created thereby. The LED depending at a distance from the fan then also moves randomly. When the environment is darkened, only the light emitted from the hole in the coating on the LED 22 can be observed and appears to move about quite randomly with a yellow/green color and turn on and off as the LED 22 rotates. Thus, a firefly is simulated.

Thus, an improved firefly simulator is disclosed. While embodiments and applications of this invention have been shown and described, it would be apparent to those skilled in the art that many more modifications are possible without departing from the inventive concepts herein. The invention, therefore is not to be restricted except in the spirit of the appended claims

What is claimed is:

1. A firefly simulation device comprising a first depending flexible line segment;

a motor driven fan mounted to swing freely at the distal end of the first depending flexible line segment, the fan capable of inducing thrust substantially in a plane normal to the first depending line segment;

a second depending flexible line segment depending from the motor driven fan;

an LED at the distal end of the second depending flexible line segment.

2. The firefly simulation device of claim 1, the LED having a body and a light transmitting opening which can be eclipsed by the LED body.

3. The firefly simulation device of claim 1, the first depending flexible line segment being a first twisted pair of wires electrically coupled with the fan.

4. The firefly simulation device of claim 3, the second depending flexible line segment being a second twisted pair of wires electrically coupled between the first twisted pair of wires and the LED.

5. The firefly simulation device of claim 1 further comprising a transformer coupled to the first depending flexible line segment at the proximal end of the first depending flexible line segment.

6. The firefly simulation device of claim 1 further comprising a resistor at the proximal end of the second depending flexible line segment.

7. A firefly simulation device comprising a first depending flexible line segment including a twisted pair of wires electrically coupled with the fan;

a motor driven fan mounted to swing freely at the distal end of the first depending flexible line segment, the fan capable of inducing thrust substantially in a plane normal to the first depending line segment;

a second depending flexible line segment depending from the motor driven fan including a twisted pair of wires electrically coupled between the fan and a LED;

the LED is positioned at the distal end of the second depending flexible line segment having a body and a light transmitting opening which can be eclipsed by the LED body.

8. The firefly simulation device of claim 7 further comprising a transformer coupled to the first depending flexible line segment at the proximal end of the first depending flexible line segment;

a resistor at the proximal end of the second depending flexible line segment.

* * * * *